US011174853B1

(12) United States Patent
Howe

(10) Patent No.: US 11,174,853 B1
(45) Date of Patent: Nov. 16, 2021

(54) HAND-OPERATED AIR PUMP

(71) Applicant: James Howe, Moscow, PA (US)

(72) Inventor: James Howe, Moscow, PA (US)

( * ) Notice: Subject to any disclaimer, the term of this patent is extended or adjusted under 35 U.S.C. 154(b) by 138 days.

(21) Appl. No.: 16/735,799

(22) Filed: Jan. 7, 2020

(51) Int. Cl.
*F04B 33/00* (2006.01)
*F04B 39/00* (2006.01)
*F04B 39/12* (2006.01)

(52) U.S. Cl.
CPC ..... *F04B 33/00* (2013.01); *F04B 39/0005* (2013.01); *F04B 39/121* (2013.01); *F04B 2205/04* (2013.01); *F04B 2205/05* (2013.01)

(58) Field of Classification Search
CPC ..... F04B 33/005; F04B 39/121; F04B 33/00; F04B 9/14
See application file for complete search history.

(56) References Cited

U.S. PATENT DOCUMENTS 2,557,139 A 6/1951 Peters
4,334,839 A * 6/1982 Flagg ..... F04B 33/00 417/536
4,508,490 A * 4/1985 Ramirez ..... F04B 41/06 417/234
4,842,489 A * 6/1989 Lucisano ..... F04B 33/005 417/238
5,676,529 A 10/1997 Hermansen
5,807,078 A * 9/1998 Chen ..... F04B 9/131 417/262
6,558,129 B2 * 5/2003 Wang ..... F04B 33/005 417/63
6,702,556 B2 3/2004 Axelsson
7,637,203 B2 * 12/2009 Moss ..... F04B 35/01 92/140
8,025,491 B2 9/2011 Wang
8,167,591 B1 5/2012 Sorensen
8,287,251 B2 * 10/2012 Weber ..... F04B 9/14 417/254
8,747,076 B2 * 6/2014 Wang ..... F04B 33/005 417/234
8,857,314 B2 10/2014 Tasyagan
D745,570 S 12/2015 Scott
2014/0193276 A1 * 7/2014 Hanson ..... F04B 33/005 417/53
2018/0119684 A1 * 5/2018 Winefordner ..... F04B 53/10
2018/0135611 A1 * 5/2018 DeBaker ..... F04B 33/005

FOREIGN PATENT DOCUMENTS

GB 2398354 10/2005

* cited by examiner

*Primary Examiner* — Dominick L Plakkoottam
(74) *Attorney, Agent, or Firm* — Kyle A. Fletcher, Esq.

(57) ABSTRACT

The hand-operated air pump is a mechanical device. The hand-operated air pump compresses atmospheric gas for use in an inflatable structure. The hand-operated air pump comprises a housing and a pump structure. The housing contains the pump structure. The housing transfers externally provisioned motive forces that are required to operate the pump structure. The pump structure compresses the atmospheric gas used in the inflatable structure. The pump structure transports the compressed atmospheric gas to the inflatable structure. The pump structure measures the pressure of atmospheric gas contained in the inflatable structure.

20 Claims, 4 Drawing Sheets

HAND-OPERATED AIR PUMP

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention present invention relates to the field of mechanical engineering including positive displacement machines, more specifically, a pump actuated by muscle power. (F04B33/05)

SUMMARY OF INVENTION

The hand-operated air pump is a mechanical device. The hand-operated air pump compresses atmospheric gas for use in an inflatable structure. The hand-operated air pump comprises a housing and a pump structure. The housing contains the pump structure. The housing transfers externally provisioned motive forces that are required to operate the pump structure. The pump structure compresses the atmospheric gas used in the inflatable structure. The pump structure transports the compressed atmospheric gas to the inflatable structure. The pump structure measures the pressure of atmospheric gas contained in the inflatable structure.

These together with additional objects, features and advantages of the hand-operated air pump will be readily apparent to those of ordinary skill in the art upon reading the following detailed description of the presently preferred, but nonetheless illustrative, embodiments when taken in conjunction with the accompanying drawings.

In this respect, before explaining the current embodiments of the hand-operated air pump in detail, it is to be understood that the hand-operated air pump is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hand-operated air pump.

It is therefore important that the claims be regarded as including such equivalent construction insofar as they do not depart from the spirit and scope of the hand-operated air pump. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
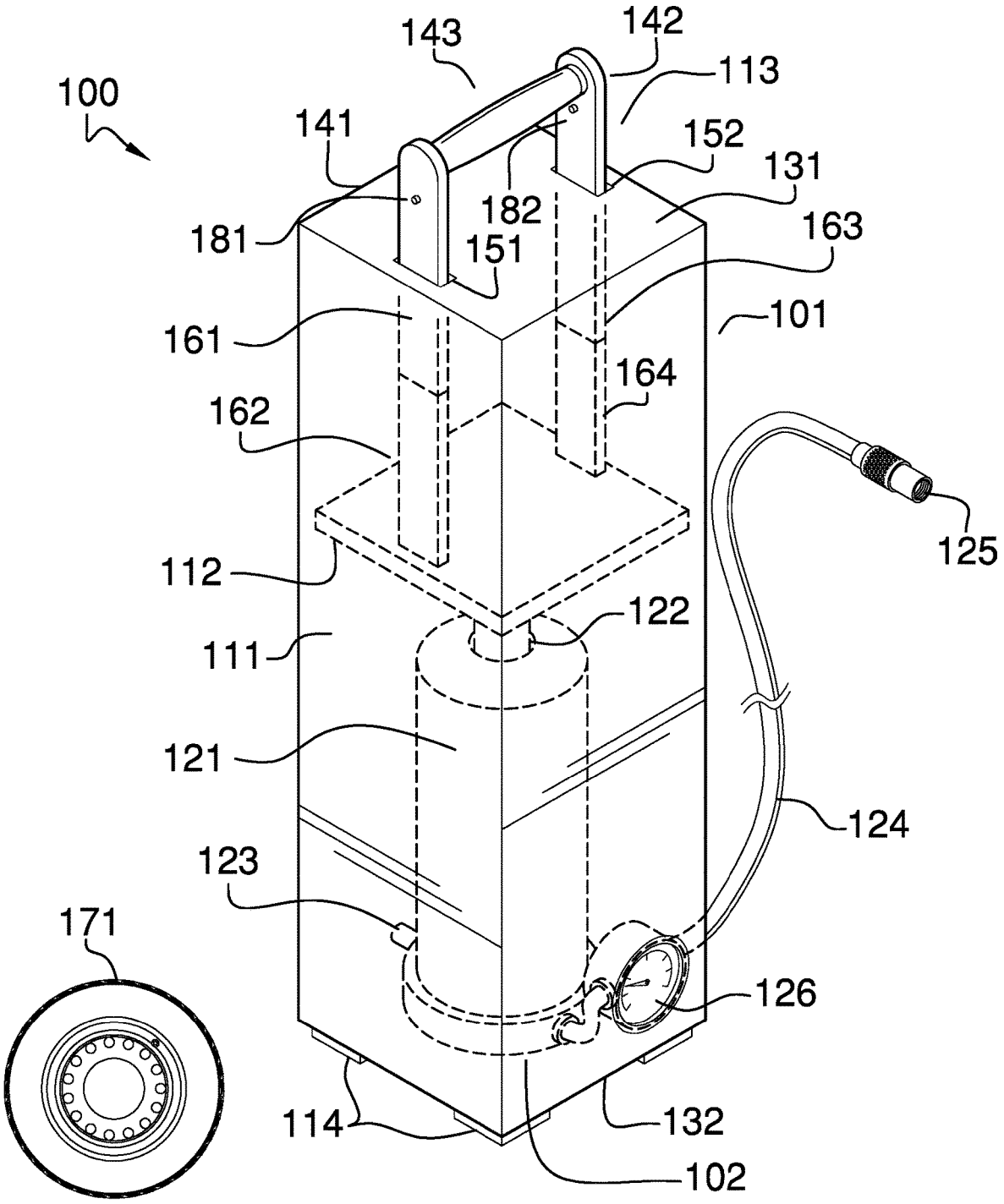
FIG. 1 is a perspective view of an embodiment of the disclosure.
Figure 2:
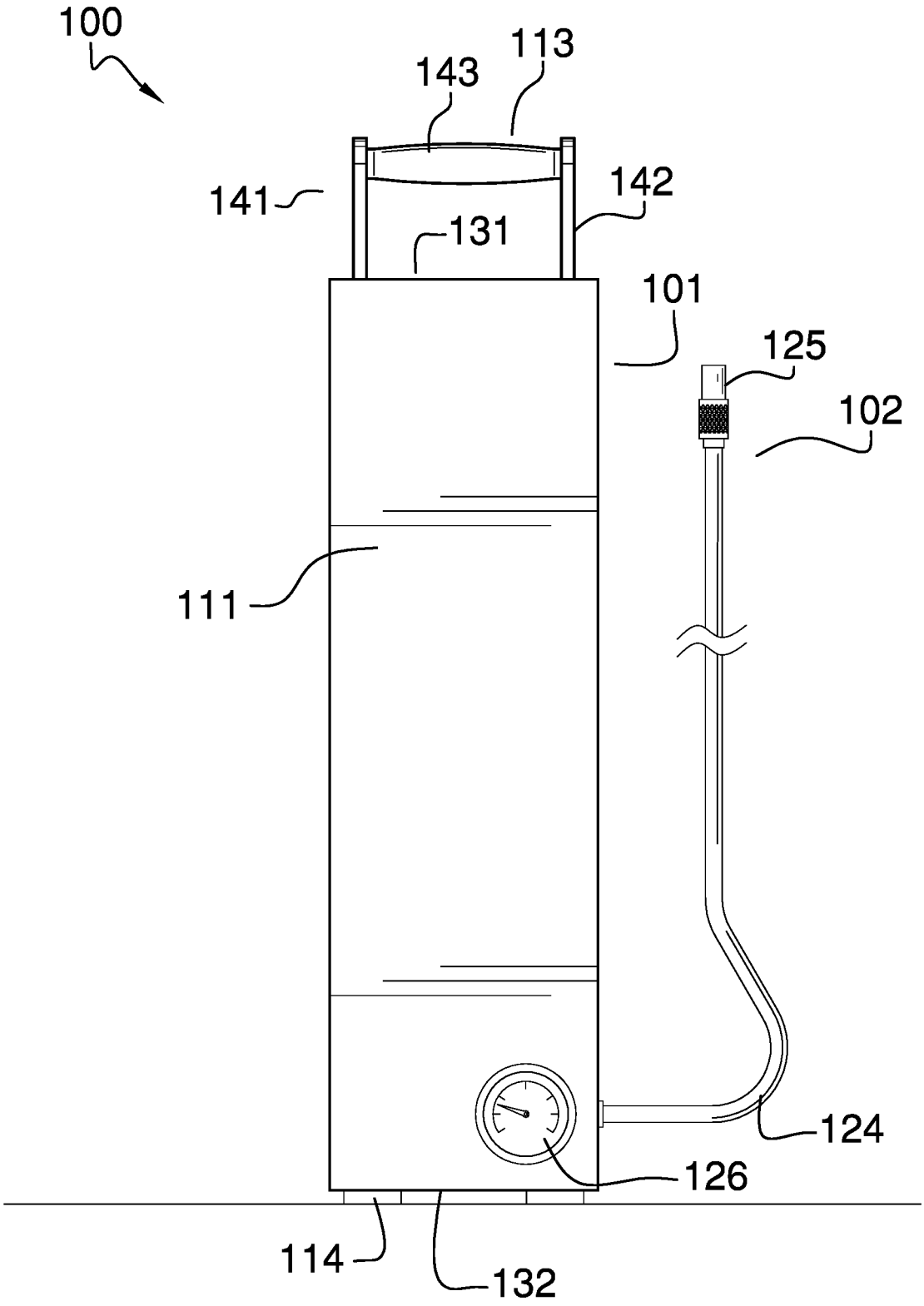
FIG. 2 is a front view of an embodiment of the disclosure.
Figure 3:
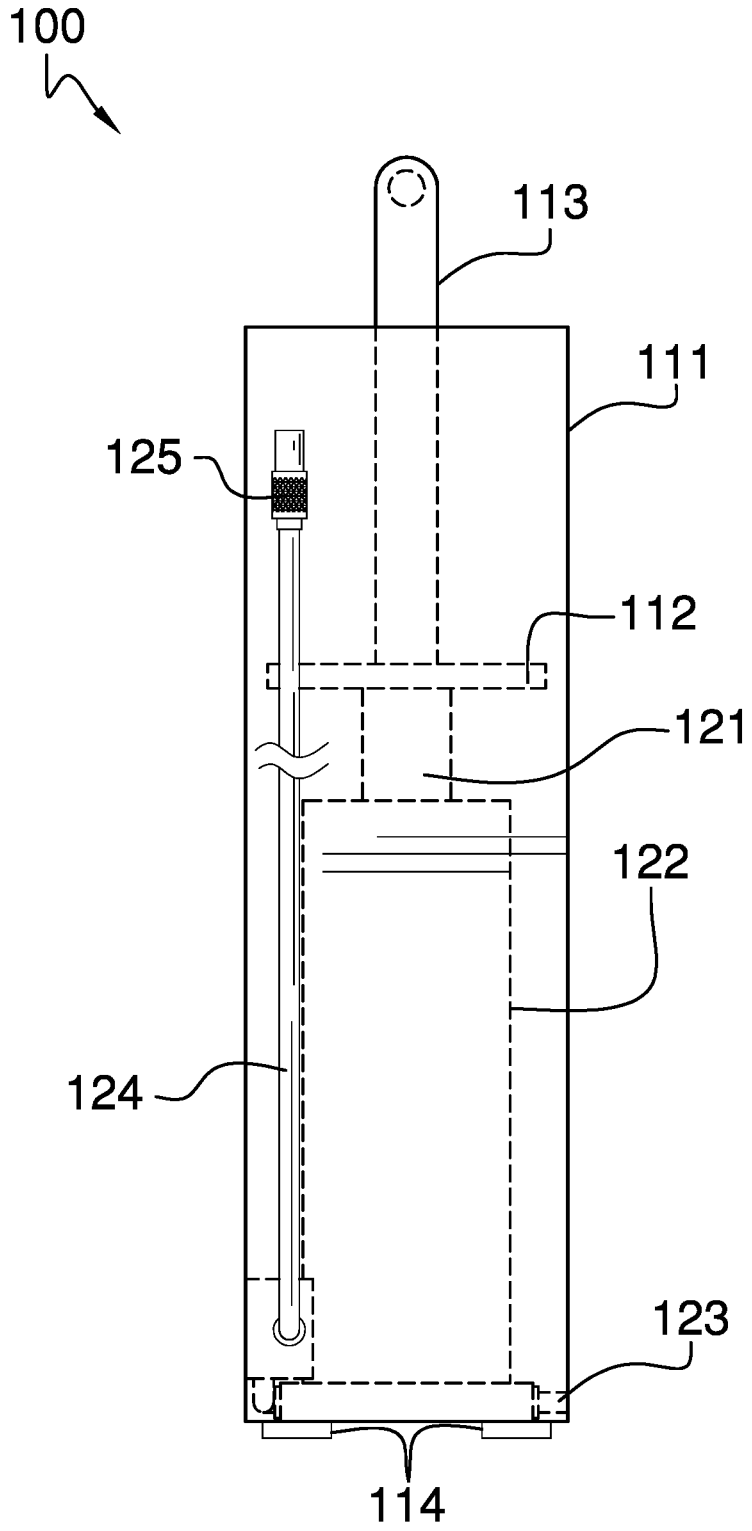
FIG. 3 is a side view of an embodiment of the disclosure.
Figure 4:
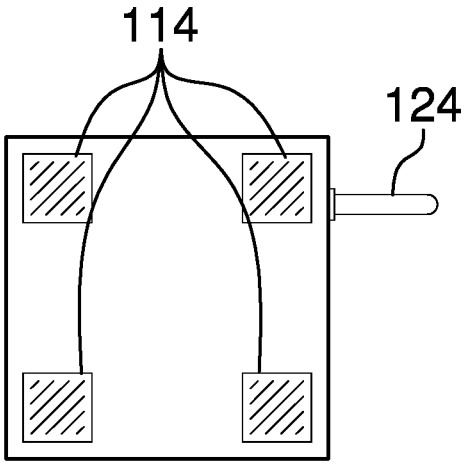
FIG. 4 is a bottom view of an embodiment of the disclosure.

Detailed reference will now be made to one or more potential embodiments of the disclosure, which are illustrated in FIGS. 1 through 4.

The hand-operated air pump 100 (hereinafter invention) is a mechanical device. The invention 100 compresses atmospheric gas for use in an inflatable structure 171. The invention 100 comprises a housing 101 and a pump structure 102. The housing 101 contains the pump structure 102. The housing 101 transfers externally provisioned motive forces that are required to operate the pump structure 102. The pump structure 102 compresses the atmospheric gas used in the inflatable structure 171. The pump structure 102 transports the compressed atmospheric gas to the inflatable structure 171. The pump structure 102 measures the pressure of atmospheric gas contained in the inflatable structure 171.

The housing 101 is a prism-shaped structure. The housing 101 is a hollow containment structure. The housing 101 is a mechanical structure that transfers externally provided motive forces to the pump structure 102. The housing 101 is a rigid casing. The housing 101 contains the pump structure 102. The housing 101 is formed with all apertures and form factors necessary to allow the housing 101 to accommodate the use and operation of the pump structure 102. Methods to form a housing 101 suitable for the purposes described in this disclosure are well-known and documented in the mechanical arts. The housing 101 comprises a shell 111, a housing 101 piston 112, a u-grip 113, and a footing 114.

The shell 111 is a prism-shaped structure. The shell 111 is a hollow containment structure. The shell 111 forms the exterior surfaces of the primary shape of the invention 100. The shell 111 is a rigid casing. The shell 111 contains the pump structure 102. The shell 111 is formed with all apertures and form factors necessary to allow the shell 111 to accommodate the use and operation of the pump structure 102. Methods to form a shell 111 suitable for the purposes described in this disclosure are well-known and documented in the mechanical arts. The shell 111 comprises a first shell 111 congruent end 131, a second shell 111 congruent end 132, and a plurality of lateral faces 133.

The first shell 111 congruent end 131 is a congruent end of the prism structure of the shell 111. The second shell 111 congruent end 132 is a congruent end of the prism structure of the shell 111. The second shell 111 congruent end 132 is the congruent end of the shell 111 that is distal from the first shell 111 congruent end 131. The plurality of lateral faces 133 forms the containment surfaces of the shell 111 that are perpendicular to the first shell 111 congruent end 131 and the second shell 111 congruent end 132. The plurality of lateral faces 133 attaches the first shell 111 congruent end 131 to the second shell 111 congruent end 132.

The housing 101 piston 112 is a prism-shaped structure. The housing 101 piston 112 has a disk structure. The housing 101 piston 112 is geometrically similar to the shell 111. The housing 101 piston 112 installs in the housing 101 such that the center axis of the disk structure of the housing 101 piston 112 aligns with the center axis of the hollow containment space formed by the shell 111 of the housing 101. The housing 101 piston 112 moves within the hollow containment space formed by the shell 111. The housing 101 piston 112 moves in a direction parallel with the center axis of the hollow containment space formed by the shell 111. A first face of the disk structure of the housing 101 piston 112 attaches directly to the pump structure 102 such that the motion of the housing 101 piston 112 in the shell 111 transfers the externally provided motive forces into the pump structure 102.

The u-grip 113 forms the handle of the housing 101 used to carry and manipulate the housing 101 and manipulate the housing 101 piston 112. The u-grip 113 attaches to a second face of the disk structure of the housing 101 piston 112. The second face of the housing 101 piston 112 is the face that is distal from the first face of the housing 101 piston 112. The u-grip 113 is a u-shaped structure. The free ends of the u-shaped structure of the u-grip 113 attach to the second face of the housing 101 piston 112. The u-grip 113 inserts into the interior space of the shell 111 to attach to the housing 101 piston 112. The u-grip 113 inserts into the interior space of the shell 111 through the first shell 111 congruent end 131. The u-grip 113 comprises a first u-grip 113 arm 141, a second u-grip 113 arm 142, and a u-grip 113 crossbeam 143.

The u-grip 113 crossbeam 143 is the crossbeam of the u-shaped structure that forms the u-grip 113. The u-grip 113 crossbeam 143 attaches the first u-grip 113 arm 141 to the second u-grip 113 arm 142.

The first u-grip 113 arm 141 attaches to the u-grip 113 crossbeam 143 in the manner of a cantilever. The free end of the cantilever structure of the first u-grip 113 arm 141 attaches to the second face of the disk structure of the housing 101 piston 112 such that the motion of the u-grip 113 will move the housing 101 piston 112 within the shell 111. The first u-grip 113 arm 141 is a telescope structure such that the span of the length between the housing 101 piston 112 and the u-grip 113 crossbeam 143 is adjustable.

The first u-grip 113 arm 141 is a telescopic structure that comprises a first telescoping arm 161, a second telescoping arm 162, and a first detent 181. The first detent 181 is a mechanical device that locks and secures the first telescoping arm 161 to the second telescoping arm 162. The first telescoping arm 161 is a hollow prism that is further defined with an inner dimension. The second telescoping arm 162 is a hollow prism that is further defined with an outer dimension. The second telescoping arm 162 is geometrically similar to the first telescoping arm 161. The span of the outer dimension of the second telescoping arm 162 is lesser than the span of the inner dimension of the first telescoping arm 161 such that the second telescoping arm 162 inserts into the first telescoping arm 161 in a telescopic fashion to form a composite prism structure.

The span of the length of the first u-grip 113 arm 141 adjusts by adjusting the relative position of the second telescoping arm 162 within the first telescoping arm 161. The position of the second telescoping arm 162 relative to the first telescoping arm 161 is held in position using the first detent 181. The first detent 181 is selected from the group consisting of a cotter pin, a G snap collar, a cam lock collar, a threaded clutch, a split collar lock, and a spring loaded ball lock.

The second u-grip 113 arm 142 attaches to the u-grip 113 crossbeam 143 in the manner of a cantilever. The free end of the cantilever structure of the second u-grip 113 arm 142 attaches to the second face of the disk structure of the housing 101 piston 112 such that the motion of the u-grip 113 will move the housing 101 piston 112 within the shell 111. The second u-grip 113 arm 142 is a telescope structure such that the span of the length between the housing 101 piston 112 and the u-grip 113 crossbeam 143 is adjustable.

The second u-grip 113 arm 142 is a telescopic structure that comprises a third telescoping arm 163, a fourth telescoping arm 164, and a second detent 182. The second detent 182 is a mechanical device that locks and secures the fourth telescoping arm 164 to the third telescoping arm 163. The third telescoping arm 163 is a hollow prism that is further defined with an inner dimension. The fourth telescoping arm 164 is a hollow prism that is further defined with an outer dimension. The fourth telescoping arm 164 is geometrically similar to the third telescoping arm 163. The span of the outer dimension of the third telescoping arm 163 is lesser than the span of the inner dimension of the fourth telescoping arm 164 such that the fourth telescoping arm 164 inserts into the third telescoping arm 163 in a telescopic fashion to form a composite prism structure.

The span of the length of the second u-grip 113 arm 142 adjusts by adjusting the relative position of the third telescoping arm 163 within the fourth telescoping arm 164. The position of the third telescoping arm 163 relative to the fourth telescoping arm 164 is held in position using the second detent 182. The second detent 182 is selected from the group consisting of a cotter pin, a G snap collar, a cam lock collar, a threaded clutch, a split collar lock, and a spring loaded ball lock.

The end of the first telescoping arm 161 that is distal from the second telescoping arm 162 attaches to the u-grip 113 crossbeam 143. The end of the second telescoping arm 162 that is distal from the first telescoping arm 161 attaches to the second face of the housing 101 piston 112. The end of the third telescoping arm 163 that is distal from the fourth telescoping arm 164 attaches to the u-grip 113 crossbeam 143. The end of the fourth telescoping arm 164 that is distal from the third telescoping arm 163 attaches to the second face of the housing 101 piston 112.

The first shell 111 congruent end 131 further comprises a first u-grip 113 aperture 151 and a second u-grip 113 aperture 152.

The first u-grip 113 aperture 151 is an aperture that is formed through the first shell 111 congruent end 131 of the shell 111. The first u-grip 113 aperture 151 is sized such that the free end of the first u-grip 113 arm 141 of the u-grip 113 inserts into the hollow interior of the shell 111 through the first u-grip 113 aperture 151. The first u-grip 113 aperture 151 receives the u-grip 113 such the first u-grip 113 arm 141 has direct access to the second face of the disk structure of the housing 101 piston 112.

The second u-grip 113 aperture 152 is an aperture that is formed through the first shell 111 congruent end 131 of the shell 111. The second u-grip 113 aperture 152 is sized such that the free end of the second u-grip 113 arm 142 of the u-grip 113 inserts into the hollow interior of the shell 111 through the second u-grip 113 aperture 152. The second u-grip 113 aperture 152 receives the u-grip 113 such the second u-grip 113 arm 142 has direct access to the second face of the disk structure of the housing 101 piston 112.

The footing 114 comprises a collection of pedestal structures that mount on the exterior surface of the second shell 111 congruent end 132 of the shell 111. The footing 114 forms the final link of the load path the transfers the load of the invention 100 to a supporting surface.

The pump structure 102 is a mechanical device. The pump structure 102 generates a pressure differential used for transporting atmospheric gases from the atmosphere into the inflatable structure 171. The pump structure 102 is a manually powered and operated device. The pump structure 102 comprises a compression chamber 121, a compression piston 122, an intake port 123, a discharge hose 124, a discharge fitting 125, and a pressure gauge 126.

The compression chamber 121 is a hollow prism-shaped structure. The compression piston 122 is a prism-shaped structure. The compression piston 122 is geometrically similar to the hollow interior of the compression chamber 121. The compression piston 122 inserts into the interior space of the compression chamber 121. An end of the compression piston 122 attaches to the first face of the disk structure of the u-grip 113.

The combination of the compression chamber 121 and the compression piston 122 forms a structure with an adjustable volume. The volume of the combined structure formed by the compression chamber 121 and the compression piston 122 adjusts by adjusting the position of the compression piston 122 within the compression chamber 121. When the compression piston 122 moves such that the pressure of the gas contained within the compression chamber 121 increases when the volume of the combined structure formed by the compression chamber 121 and the compression piston 122 decreases. The use of a combination of the compression chamber 121 and the compression piston 122 to compress an atmospheric gas is well-known and documented in the mechanical arts.

The intake port 123 is a valve and port that is formed through the lateral face of the prism structure of the compression chamber 121. The intake port 123 draws atmospheric gas into the compression chamber 121 when the compression piston 122 moves to increase the volume of the combined structure formed by the compression chamber 121 and the compression piston 122.

The discharge hose 124 is a hose that forms a fluidic connection between the interior space of the compression chamber and the inflatable structure 171. The discharge hose 124 transfers the atmospheric gas from the compression chamber 121 into the inflatable structure 171.

The discharge fitting 125 is a fitting. The fitting is defined elsewhere in this disclosure. The discharge fitting 125 forms the physical fluidic connection between the discharge hose 124 and the inflatable structure 171. In the first potential embodiment of the disclosure, the discharge fitting 125 is configured to attach to a stem valve that is provisioned by the inflatable structure 171.

The pressure gauge 126 is a gauge used to measure the pressure of the atmospheric gas contained within the compression chamber 121. The gauge is defined elsewhere in this disclosure. The pressure gauge 126 is positioned on the exterior surface of the lateral face of the shell 111 such that the pressure gauge 126 is visible from the exterior of the shell 111.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Detent: As used in this disclosure, a detent is a device for positioning and holding a first object relative to a second object such that the position of the first object relative to the second object is adjustable.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Fitting: As used in this disclosure, a fitting is a component that is attached to a first object. The fitting is used to forming a fluidic connection between the first object and a second object.

Fluid: As used in this disclosure, a fluid refers to a state of matter wherein the matter is capable of flow and takes the shape of a container it is placed within. The term fluid commonly refers to a liquid or a gas.

Footing: As used in this disclosure, a footing refers to one of a plurality of small pedestals that combine to: a) raise an object above a supporting surface; and, b) transfer the load path of the object to the supporting surface.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Gauge: As used in this disclosure, a gauge is a measurement device that is configured to display the value that is being measured. Air pressure gauges and temperature gauges are well-known gauges.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Hose: As used in this disclosure, a hose is a flexible hollow prism-shaped device that is used for transporting liquids and gases. When referring to a hose in this disclosure, the terms inner dimension and outer dimension are used as they would be used by those skilled in the plumbing arts.

Housing: As used in this disclosure, a housing is a rigid structure that encloses and protects one or more devices.

Inflatable Structure: As used in this disclosure, an inflatable structure is a fluid impermeable semi-rigid structure that is configured to contain a gas under pressure. The volume of the containment space formed by the inflatable structure is a function of the pressure differential between the pressure of the gas contained within the inflatable structure and the pressure of the exterior gas surrounding the inflatable structure.

Inflation: As used in this disclosure, inflation refers to filling the interior of an enclosed fluid impermeable semi-rigid structure with gas at a pressure greater than the exterior gas pressure of the enclosed fluid impermeable semi-rigid structure. The infinitive of the verbal form for inflation is to inflate.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pedestal: As used in this disclosure, a pedestal is an intermediary load bearing structure that that forms a load path between a supporting surface and an object, structure, or load.

Perimeter: As used in this disclosure, a perimeter is one or more curved or straight lines that bounds an enclosed area on a plane or surface. The perimeter of a circle is commonly referred to as a circumference.

Port: As used in this disclosure, a port is an aperture formed in an object that allows fluid to flow through the boundary of the object.

Pressure: As used in this disclosure, pressure refers to a measure of force per unit area.

Primary Shape: As used in this disclosure, the primary shape refers to a description of the overall geometric shape of an object that is assembled from multiple components.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pump: As used in this disclosure, a pump is a mechanical device that uses suction or pressure to raise or move fluids, compress fluids, or force a fluid into an inflatable object. Within this disclosure, a compressor refers to a pump that is dedicated to compressing a fluid or placing a fluid under pressure.

Rectangular Block: As used in this disclosure, a rectangular block refers to a three-dimensional prism structure comprising six rectangular surfaces (commonly called faces) formed at right angles. Within this disclosure, a rectangular block may further comprise rounded edges and corners.

Shell: As used in this disclosure, a shell is a structure that forms an outer covering intended to contain an object. Shells are often, but not necessarily, rigid or semi-rigid structures that are intended to protect the object contained within it.

Stem Valve: As used in this disclosure, a stem valve is a check valve/fitting combination that is actuated by a pressure differential. Specifically, the stem valve allows a gas to flow through the stem valve from a high pressure gas source to a contained space containing a lower pressure gas. The fitting is designed such that the source of the high pressure gas can be removed from the stem valve with a minimal loss of gas from the lower pressure gas escaping through the stem valve during the disconnection process. Stem valves are commonly used to allow for the inflation of tires.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Telescopic: As used in this disclosure, telescopic is an adjective that describes an object made of sections that fit or slide into each other such that the object can be made longer or shorter by adjusting the relative positions of the sections.

Tube: As used in this disclosure, a tube is a hollow prism-shaped device formed with two open ends. The tube is used for transporting liquids and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

U-Grip: As used in this disclosure, a U-Grip is a U-shaped structure that attaches to a surface to form a graspable handle.

U-Shaped Structure: As used in this disclosure, a U-shaped structure refers to a three-sided structure comprising a crossbeam, a first arm, and a second arm. In a U-shaped structure, the first arm and the second arm project away from the crossbeam: 1) in the same direction; 2) at a roughly perpendicular angle to the crossbeam, and, 3) the span of the length of the first arm roughly equals the span of the length of the second arm. The first arm and the second arm project away from the crossbeam in the manner of a cantilever.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed as:

1. A hand-operated air pump comprising
a housing and a pump structure;
wherein the housing contains the pump structure;
wherein the housing transfers externally provisioned motive forces that are required to operate the pump structure;
wherein the hand-operated air pump compresses atmospheric gas for use in an inflatable structure;
wherein the pump structure transports the compressed atmospheric gas to the inflatable structure;
wherein the pump structure measures the pressure of atmospheric gas contained in the inflatable structure;
wherein the housing comprises a shell, a housing piston, a u-grip, and a footing;
wherein the shell comprises a first shell congruent end, a second shell congruent end, and a plurality of lateral faces;
wherein the first shell congruent end is a congruent end of a prism structure of the shell;
wherein the second shell congruent end is a congruent end of the prism structure of the shell;
wherein the second shell congruent end is the congruent end of the shell that is distal from the first shell congruent end;
wherein the plurality of lateral faces forms the containment surfaces of the shell that are perpendicular to the first shell congruent end and the second shell congruent end.

2. The hand-operated air pump according to claim 1
wherein the housing is a hollow containment structure;
wherein the housing is a rigid casing.

3. The hand-operated air pump according to claim 2
wherein the shell is a hollow containment structure;
wherein the shell forms the exterior surfaces of the primary shape of the hand-operated air pump;
wherein the shell is a rigid casing;
wherein the shell contains the pump structure.

4. The hand-operated air pump according to claim 3
wherein the plurality of lateral faces attaches the first shell congruent end to the second shell congruent end.

5. The hand-operated air pump according to claim 4
wherein the housing piston is a prism-shaped structure;
wherein the housing piston has a disk structure;
wherein the housing piston is geometrically similar to the shell;
wherein the housing piston installs in the housing such that the center axis of the disk structure of the housing piston aligns with the center axis of the hollow containment space formed by the shell of the housing;
wherein the housing piston moves within the hollow containment space formed by the shell;
wherein the housing piston moves in a direction parallel with the center axis of the hollow containment space formed by the shell;
wherein a first face of the disk structure of the housing piston attaches directly to the pump structure such that the motion of the housing piston in the shell transfers the externally provided motive forces into the pump structure.

6. The hand-operated air pump according to claim 5
wherein the u-grip forms the handle of the housing used to carry and manipulate the housing and manipulate the housing piston;
wherein the u-grip attaches to a second face of the disk structure of the housing piston;
wherein the second face of the housing piston is the face that is distal from the first face of the housing piston.

7. The hand-operated air pump according to claim 6
wherein the u-grip is a u-shaped structure;
wherein the free ends of the u-shaped structure of the u-grip attach to the second face of the housing piston;
wherein the u-grip inserts into the interior space of the shell to attach to the housing piston;
wherein the u-grip inserts into the interior space of the shell through the first shell congruent end.

8. The hand-operated air pump according to claim 7
wherein the u-grip comprises a first u-grip arm, a second u-grip arm, and a u-grip crossbeam;
wherein the u-grip crossbeam is the crossbeam of the u-shaped structure that forms the u-grip;
wherein the u-grip crossbeam attaches the first u-grip arm to the second u-grip arm.

9. The hand-operated air pump according to claim 8
wherein the first u-grip arm attaches to the u-grip crossbeam in the manner of a cantilever;
wherein the free end of the cantilever structure of the first u-grip arm attaches to the second face of the disk structure of the housing piston such that the motion of the u-grip will move the housing piston within the shell.

10. The hand-operated air pump according to claim 9
wherein the second u-grip arm attaches to the u-grip crossbeam in the manner of a cantilever;
wherein the free end of the cantilever structure of the second u-grip arm attaches to the second face of the disk structure of the housing piston such that the motion of the u-grip will move the housing piston within the shell.

11. The hand-operated air pump according to claim 10
wherein the first u-grip arm is a telescope structure such that the span of the length between the housing piston and the u-grip crossbeam is adjustable;
wherein the first u-grip arm is a telescopic structure that comprises a first telescoping arm, a second telescoping arm, and a first detent;
wherein the first detent is a mechanical device that locks and secures the first telescoping arm to the second telescoping arm;
wherein the first telescoping arm is a hollow prism that is further defined with an inner dimension;
wherein the second telescoping arm is a hollow prism that is further defined with an outer dimension;
wherein the second telescoping arm is geometrically similar to the first telescoping arm;
wherein the span of the outer dimension of the second telescoping arm is lesser than the span of the inner dimension of the first telescoping arm such that the second telescoping arm inserts into the first telescoping arm in a telescopic fashion to form a composite prism structure;
wherein the span of the length of the first u-grip arm adjusts by adjusting the relative position of the second telescoping arm within the first telescoping arm;
wherein the position of the second telescoping arm relative to the first telescoping arm is held in position using the first detent.

12. The hand-operated air pump according to claim 11
wherein the second u-grip arm is a telescope structure such that the span of the length between the housing piston and the u-grip crossbeam is adjustable;
wherein the second u-grip arm is a telescopic structure that comprises a third telescoping arm, a fourth telescoping arm, and a second detent;
wherein the second detent is a mechanical device that locks and secures the fourth telescoping arm to the third telescoping arm;
wherein the third telescoping arm is a hollow prism that is further defined with an inner dimension;
wherein the fourth telescoping arm is a hollow prism that is further defined with an outer dimension;
wherein the fourth telescoping arm is geometrically similar to the third telescoping arm;
wherein the span of the outer dimension of the third telescoping arm is lesser than the span of the inner dimension of the fourth telescoping arm such that the fourth telescoping arm inserts into the third telescoping arm in a telescopic fashion to form a composite prism structure;
wherein the span of the length of the second u-grip arm adjusts by adjusting the relative position of the third telescoping arm within the fourth telescoping arm;
wherein the position of the third telescoping arm relative to the fourth telescoping arm is held in position using the second detent.

13. The hand-operated air pump according to claim 12
wherein the end of the first telescoping arm that is distal from the second telescoping arm attaches to the u-grip crossbeam;
wherein the end of the second telescoping arm that is distal from the first telescoping arm attaches to the second face of the housing piston;
wherein the end of the third telescoping arm that is distal from the fourth telescoping arm attaches to the u-grip crossbeam;
wherein the end of the fourth telescoping arm that is distal from the third telescoping arm attaches to the second face of the housing piston.

14. The hand-operated air pump according to claim 13
wherein the first shell congruent end further comprises a first u-grip aperture and a second u-grip aperture;
wherein the first u-grip aperture is an aperture that is formed through the first shell congruent end of the shell;
wherein the first u-grip aperture is sized such that the free end of the first u-grip arm of the u-grip inserts into the hollow interior of the shell through the first u-grip aperture;
wherein the first u-grip aperture receives the u-grip such the first u-grip arm has direct access to the second face of the disk structure of the housing piston;
wherein the second u-grip aperture is an aperture that is formed through the first shell congruent end of the shell;
wherein the second u-grip aperture is sized such that the free end of the second u-grip arm of the u-grip inserts into the hollow interior of the shell through the second u-grip aperture;
wherein the second u-grip aperture receives the u-grip such the second u-grip arm has direct access to the second face of the disk structure of the housing piston.

15. The hand-operated air pump according to claim 14
wherein the footing comprises a collection of pedestal structures that mount on the exterior surface of the second shell congruent end of the shell;
wherein the footing forms the final link of the load path the transfers the load of the hand-operated air pump to a supporting surface.

16. The hand-operated air pump according to claim 15
wherein the pump structure is a mechanical device;
wherein the pump structure generates a pressure differential.

17. The hand-operated air pump according to claim 16
wherein the pump structure comprises a compression chamber, a compression piston, an intake port, a discharge hose, a discharge fitting, and a pressure gauge;
wherein the compression piston inserts into the interior space of the compression chamber;

wherein the combination of the compression chamber and the compression piston forms a structure with an adjustable volume;

wherein the volume of the combined structure formed by the compression chamber and the compression piston adjusts by adjusting the position of the compression piston within the compression chamber;

wherein when the compression piston moves such that the pressure of the gas contained within the compression chamber increases when the volume of the combined structure formed by the compression chamber and the compression piston decreases;

wherein the intake port is a valve and port that is formed through the lateral face of the prism structure of the compression chamber;

wherein the discharge hose is a hose that forms a fluidic connection between the interior space of the compression chamber and the inflatable structure;

wherein the discharge fitting is a fitting;

wherein the discharge fitting forms the physical fluidic connection between the discharge hose and the inflatable structure;

wherein the pressure gauge is a gauge used to measure the pressure of the atmospheric gas contained within the compression chamber.

18. The hand-operated air pump according to claim 17 wherein the compression chamber is a hollow prism-shaped structure;

wherein the compression piston is a prism-shaped structure;

wherein the compression piston is geometrically similar to the hollow interior of the compression chamber;

wherein an end of the compression piston attaches to the first face of the disk structure of the u-grip.

19. The hand-operated air pump according to claim 18 wherein the discharge fitting is configured to attach to a stem valve that is provisioned by the inflatable structure.

20. The hand-operated air pump according to claim 19 wherein the pressure gauge is positioned on the exterior surface of the lateral face of the shell such that the pressure gauge is visible from the exterior of the shell.

* * * * *